US011814776B2

(12) United States Patent
Song

(10) Patent No.: US 11,814,776 B2
(45) **Date of Patent: *Nov. 14, 2023**

(54) PUMP MOTOR AND WASHING MACHINE HAVING THE SAME

(71) Applicant: Samsung Electronics Co., Ltd., Suwon-si (KR)

(72) Inventor: Hyun-woo Song, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/663,356

(22) Filed: May 13, 2022

(65) Prior Publication Data

US 2022/0275562 A1 Sep. 1, 2022

Related U.S. Application Data

(60) Division of application No. 17/304,833, filed on Jun. 25, 2021, now Pat. No. 11,332,875, which is a (Continued)

(30) Foreign Application Priority Data

Dec. 24, 2015 (KR) ..... 10-2015-0186745

(51) Int. Cl.
*D06F 39/08* (2006.01)
*D06F 37/04* (2006.01)
(Continued)

(52) U.S. Cl.
CPC ..... *D06F 39/085* (2013.01); *D06F 37/04* (2013.01); *D06F 37/10* (2013.01); *D06F 37/20* (2013.01); *D06F 37/206* (2013.01); *D06F 39/08* (2013.01); *F04D 13/06* (2013.01); *F04D 13/0693* (2013.01); *F04D 29/086* (2013.01); *D06F 37/42* (2013.01); *D06F 39/081* (2013.01)

(58) Field of Classification Search
CPC ..... D06F 39/085
See application file for complete search history.

(56) References Cited

U.S. PATENT DOCUMENTS 4,534,609 A 8/1985 White
7,195,466 B2 3/2007 Kobayashi et al.
(Continued)

FOREIGN PATENT DOCUMENTS

CN 1573079 A 2/2005
CN 1862918 A 11/2006
(Continued)

OTHER PUBLICATIONS

ISA/KR, International Search Report and Written Opinion of the International Searching Authority, International Application No. PCT/KR2016/015162, dated Mar. 30, 2017, 19 pages.
(Continued)

*Primary Examiner* — Jason Y Ko

(57) ABSTRACT

A pump motor is disclosed. The pump motor includes a case; a socket part disposed in a portion of the case and provided with a terminal part thereinside; and a cover part detachably coupled to the case and configured to open and close the socket part, wherein the socket part includes a moisture blocking member configured to block a gap between the case and the cover part.

20 Claims, 10 Drawing Sheets

Related U.S. Application Data continuation of application No. 16/780,675, filed on Feb. 3, 2020, now Pat. No. 11,466,392, which is a continuation of application No. 15/767,118, filed as application No. PCT/KR2016/015162 on Dec. 23, 2016, now Pat. No. 10,550,505.

(51) Int. Cl.

| | |
|---|---|
| ***D06F 37/20*** | (2006.01) |
| ***F04D 13/06*** | (2006.01) |
| ***F04D 29/08*** | (2006.01) |
| ***D06F 37/10*** | (2006.01) |
| *D06F 37/42* | (2006.01) |

(56) References Cited

U.S. PATENT DOCUMENTS

| | | | |
|---|---|---|---|
| 7,400,073 | B2 | 7/2008 | Yanagisawa et al. |
| 8,624,451 | B2 | 1/2014 | Shi et al. |
| 2004/0253125 | A1 | 12/2004 | Kobayashi et al. |
| 2006/0258540 | A1 | 11/2006 | Yanagisawa et al. |
| 2013/0143481 | A1 | 6/2013 | Kagawa et al. |

FOREIGN PATENT DOCUMENTS

| | | | |
|---|---|---|---|
| CN | 103026142 | A | 4/2013 |
| CN | 204436720 | U | 7/2015 |
| CN | 204794474 | U | 11/2015 |
| JP | 08321369 | A | 12/1996 |
| JP | 2000205196 | A | 7/2000 |
| JP | 2004-141567 | A | 5/2004 |
| JP | 2005-318742 | A | 11/2005 |
| JP | 2009303463 | A | 12/2009 |
| JP | 2013172056 | A | 9/2013 |
| JP | 3188485 | U | 1/2014 |
| JP | 2014-110092 | A | 6/2014 |
| JP | 2015-092803 | A | 5/2015 |
| KR | 10-2001-0110962 | A | 12/2001 |
| KR | 10-2007-0027002 | A | 3/2007 |
| KR | 10-2008-0093344 | A | 10/2008 |
| KR | 10-2008-0107500 | A | 12/2008 |
| KR | 20-2015-0000078 | U | 1/2015 |

OTHER PUBLICATIONS

Office Action dated Mar. 26, 2020 in connection with Chinese Patent Application No. 201680068698.8, 18 pages.

Notice of Preliminary Rejection dated Feb. 25, 2020 in connection with Korean Patent Application No. 10-2015-0186745, 13 pages.

The Second Office Action dated Sep. 17, 2020 in connection with Chinese Application No. 201680068698.8, 15 pages.

Notice of Preliminary Rejection dated Apr. 8, 2021 in connection with Korean Patent Application No. 10-2020-0176571, 11 pages.

Korean Intellectual Property Office, "Notice of Preliminary Rejection" dated Jan. 14, 2022, in connection with Korean Patent Application No. 10-2021-0131154, 9 pages.

Korean Intellectual Property Office, "Notice of Decision of Rejection," dated Jul. 12, 2022, in connection with Korean Patent Application No. 10-2021-0131154, 7 pages.

Office Action dated Feb. 3, 2023, in connection with Chinese Patent Application No. 202110733665.3, 10 pages.

Korean Intellectual Property Office, "Notice of Allowance," dated Nov. 3, 2022, in connection with Korean Patent Application No. 10-2021-0131154, 7 pages.

Office Action dated Jul. 21, 2023, in connection with Chinese Patent Application 202110733665.3, 8 pages.

Office Action dated Jun. 30, 2023, in connection Korean Patent Application No. 10-2023-0015425, 9 pages.

PUMP MOTOR AND WASHING MACHINE HAVING THE SAME

CROSS-REFERENCE TO RELATED APPLICATIONS

This application is a division of application Ser. No. 17/304,833, filed Jun. 25, 2021, which is a continuation of application Ser. No. 16/780,675, filed Feb. 3, 2020, which is a continuation of application Ser. No. 15/767,118, filed Apr. 9, 2018, now U.S. Pat. No. 10,550,505, which is the National Stage of International Application No. PCT/KR2016/015162, filed Dec. 23, 2016, which claims priority to Korean Patent Application No. KR 10-2015-0186745, filed Dec. 24, 2015, the disclosures of which are herein incorporated by reference in their entirety.

BACKGROUND

1. Field

The present disclosure relates to a pump motor having improved safety and a washing machine having the same.

2. Description of Related Art

In general, household appliances using water, such as washing machines, dishwashers, and the like, can discharge the used water to the outside of the household appliances through a pump motor.

As an example of the household appliances using water, a washing machine is an apparatus for removing foreign matters from laundry by the friction between washing water and the laundry, and may include a water drainage device for discharging the used washing water to the outside from the water tank for receiving the washing water. When the washing of the laundry is finished, the washing water contaminated during the washing process is discharged to the outside through the water drainage device. Discharge of the contaminated washing water may be achieved by driving a pump motor of the water drainage device.

Since such a pump motor is provided inside the household appliance using water, moisture may be introduced into the pump motor during the operation of the household appliance. In the case where moisture is introduced into a terminal part that supplies power to the pump motor, a plurality of terminals may be electrically connected to each other by moisture so that short-circuiting or tracking phenomenon may occur. Accordingly, there is the risk of fire.

SUMMARY

It is an object of the present disclosure to provide a pump motor capable of blocking moisture that can flow into the pump motor in advance and a washing machine having the same.

In order to achieve the above-described object, an aspect of the present disclosure is to provide a pump motor which may include a case; a socket part disposed in a portion of the case and provided with a terminal part thereinside; and a cover part detachably coupled to the case and configured to open and close the socket part, wherein the socket part may include a moisture blocking member configured to block a gap between the case and the cover part.

In order to achieve the above-described object, another aspect of the present disclosure is to provide a pump motor which may include a case; a terminal part including a first terminal and a second terminal; a socket part disposed in a portion of the case and provided with the terminal part thereinside; and a cover part detachably coupled to the case and configured to open and close the socket part, wherein the socket part may include a body part surrounding the terminal part; a moisture blocking member bent along an edge of the body part outward of the socket part and configured to block a gap between the case and the cover part; at least one barrier configured to partition between the first terminal and the second terminal; and a plurality of drain holes with the at least one barrier in between.

In order to achieve the above-described object, another aspect of the present disclosure is to provide a washing machine which may include a main body provided with a water tub; and a pump motor configured to discharge washing water that is accommodated in the water tub, wherein the pump motor may include a case: a socket part disposed in a portion of the case and provided with a terminal part thereinside; and a cover part detachably coupled to the case and configured to open and close the socket part, and wherein the socket part may include a moisture blocking member configured to block a gap between the case and the cover part.

DETAILED DESCRIPTION

Figure 1:
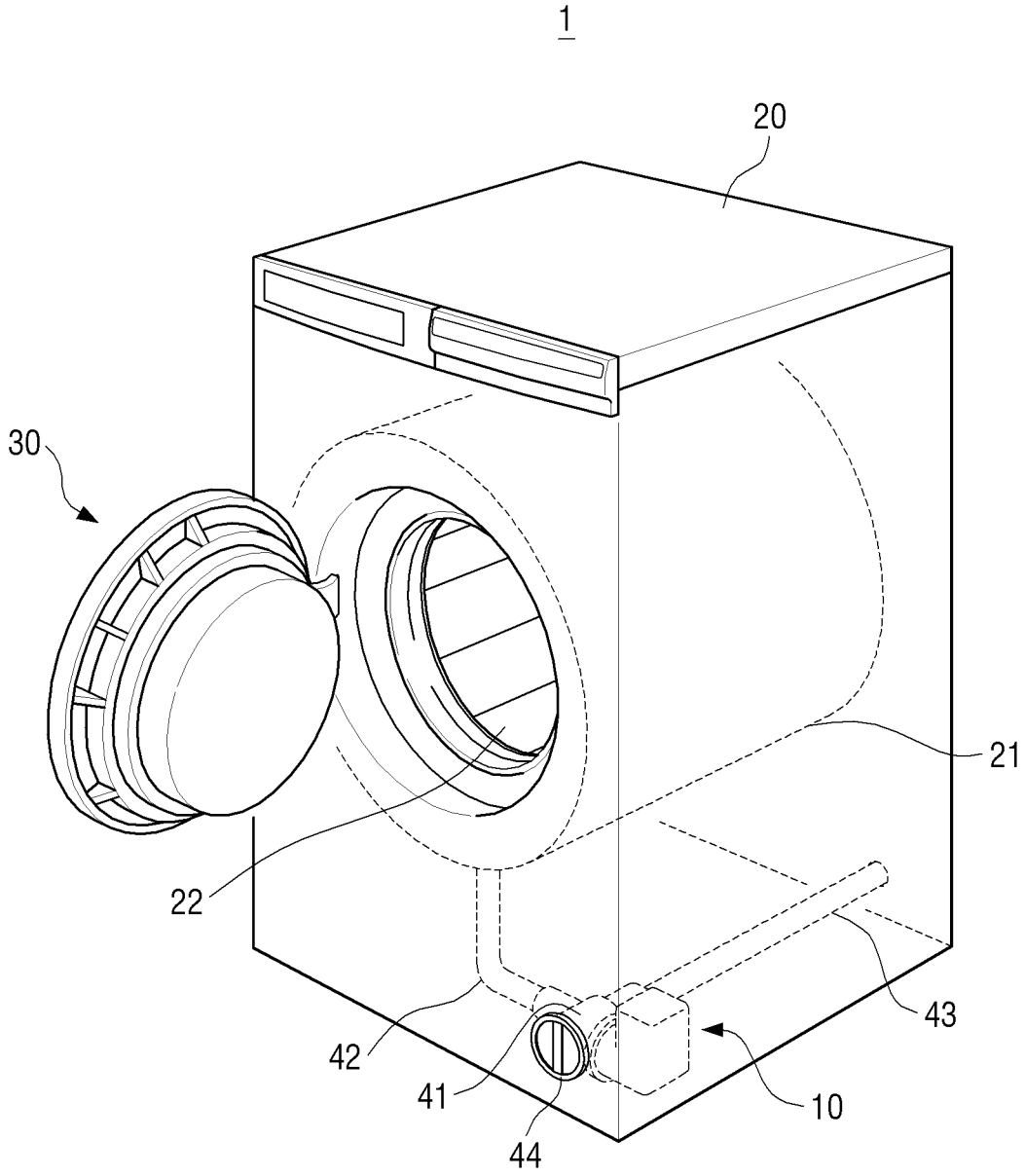
FIG. 1 is a perspective view schematically illustrating a washing machine including a pump motor according to an embodiment of the present disclosure.

Hereinafter, embodiments of the present disclosure will be described in detail with reference to the accompanying drawings. The embodiments described below will be described on the basis of embodiments best suited to understand the technical features of the present disclosure and the technical features of the present disclosure are not limited by the embodiments described. The present disclosure may be implemented as the embodiments described below.

The present disclosure is capable of various modifications within the scope of the present disclosure through the embodiments described below and such modifications will fall within the technical scope of the present disclosure. In regard to reference numerals indicated in the accompanying drawings in order to facilitate understanding of the embodiments to be described below, related components among components that perform the same operation in each embodiment are indicated by the same or extension numeral.

FIG. 1 is a perspective view schematically illustrating a washing machine 1 including a pump motor 10 according to an embodiment of the present disclosure.

The washing machine 1 may include a main body 20 that forms an outer appearance thereof and is provided with an opening on the front surface thereof and a door 30 to open and close the opening. The main body 20 may include a water tub 21 for storing washing water and a rotary tub 22 that is rotatably disposed inside the water tub 21 and accommodates laundry.

A drainage device 40 for discharging the washing water stored in the water tub 21 to the outside may be provided below the water tub 21.

The drainage device 40 may include a pump 41 including a drainage filter 44, a first drainage pipe 42 connecting the water tub 21 and the pump 41, and a second drainage pipe 43 to discharge the washing water passed through the pump 41 to the outside of the washing machine 1. An impeller (not illustrated) of the pump motor 10 may be disposed inside the pump 41, and the washing water may be discharged to the outside of the washing machine 1 through the first and second drainage pipes 42 and 43 by rotation of the impeller.

Figure 2:
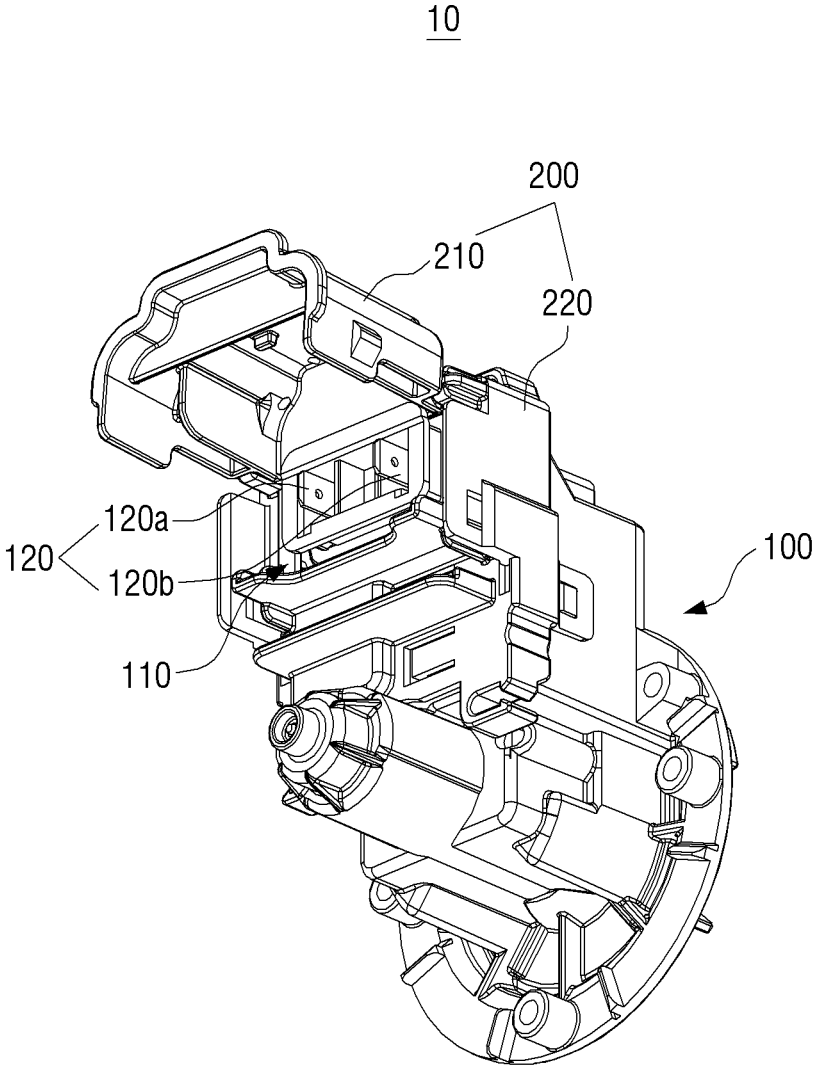
FIG. 2 is a perspective view specifically illustrating the pump motor illustrated in FIG. 1.
Figure 3:
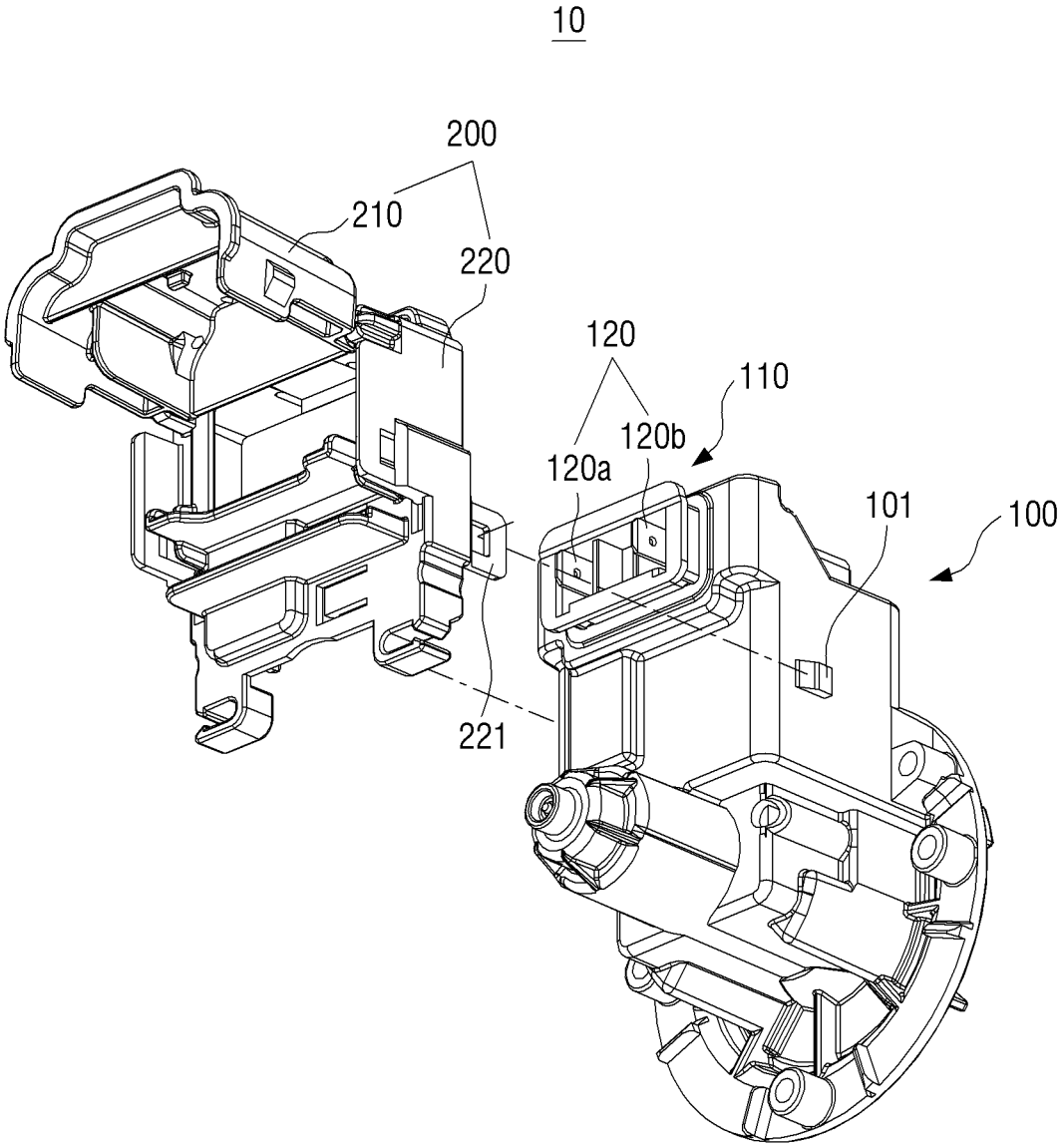
FIG. 3 is an exploded perspective view illustrating the pump motor illustrated in FIG. 2.

FIG. 2 is a perspective view specifically illustrating the pump motor 10 illustrated in FIG. 1, and FIG. 3 is an exploded perspective view illustrating the pump motor 10 illustrated in FIG. 2.

Referring to FIG. 2, the pump motor 10 may include a case 100 forming an outer appearance thereof and a cover part 200 detachably coupled to the case 100. A motor (not illustrated) including a stator (not illustrated) and a rotor (not illustrated) may be provided inside of the case 100. The impeller connected to a rotary shaft (not illustrated) may rotate as the rotary shaft connected to the rotor rotates.

Referring to FIG. 3, a socket part 110 including a terminal part 120 therein may be disposed in a portion of the case 100.

The terminal part 120 may be supplied with power from a power source (not illustrated) provided in the washing machine 1. The terminal part 120 may include a pair of a first terminal 120*a* and a second terminal 120*b* protruding from the case toward the front (for example, a direction in which the cover part 200 is disposed) for connection with an electric wire (not illustrated). Thus, the pump motor 10 may be operated by receiving electricity from the power supply.

The first and second terminals 120*a* and 120*b* may be AC terminals or DC terminals. In addition, each of the first and second terminals 120*a* and 120*b* may have a rectangular plate-like structure or a cylindrical shape arranged long in the longitudinal direction. For convenience of explanation, the terminal part 120 in the embodiment of the present disclosure is described to provide with a pair of first and second terminals 120*a* and 120*b*, but the terminal part 120 is not limited thereto. The terminal part 120 may include three or more terminals.

The socket part 110 may include the terminal part 120 described above in the inside thereof and may surround the terminal part 120. In addition, the socket part 110 may include an opening 115 opened toward the front so that the terminal part 120 is connected to the electric wire.

Further, the pump motor 10 may include the cover part 200 that can prevent moisture from flowing into the socket part 110 having the terminal part 120 from the outside. The cover part 200 is configured to cover a portion of the case 100 including the socket part 110 and may include a rear cover 220 detachably coupled to the case 100 and a front cover 210, one end of which is pivotally coupled to the rear cover 220.

Referring to FIG. 3, the rear cover 220 may have a pair of coupling grooves 221 and 222 at opposite side ends thereof, and a pair of coupling projections 101 and 102 may be provided on opposite sides of the case 100 corresponding to this. Accordingly, the pair of coupling grooves 221 and 222 of the rear cover 220 may be snap-engaged with the coupling projections 101 and 102 of the case 100, respectively, through which the rear cover 220 and the front cover 210 coupled thereto may be detachably coupled to the case 100.

The front cover 210 may be pivoted between a first position (see FIG. 7) for closing the socket part 110 and a second position (see FIG. 9) for opening the socket part 110. Therefore, when connecting the electric wire to the terminal part 120 or maintaining the terminal part 120, the socket part 110 is opened by rotating the front cover 210 to the second position, and normally the socket part 110 may be closed by rotating the front cover 210 to the first position. Thus, it is possible to prevent moisture from flowing into the socket part 110 due to vibration or the like that may occur during operation of the washing machine 1.

Further, the socket part 110 may include a moisture blocking member 112 that blocks a gap between the case 100 and the cover part 200 to prevent the inflow of moisture, at least one barrier 113 capable of preventing movement of moisture between the first and second terminals 120*a* and 120*b*, and at least one drain hole 114 that discharges the moisture introduced into the socket part 110 to the outside.

Figure 4:
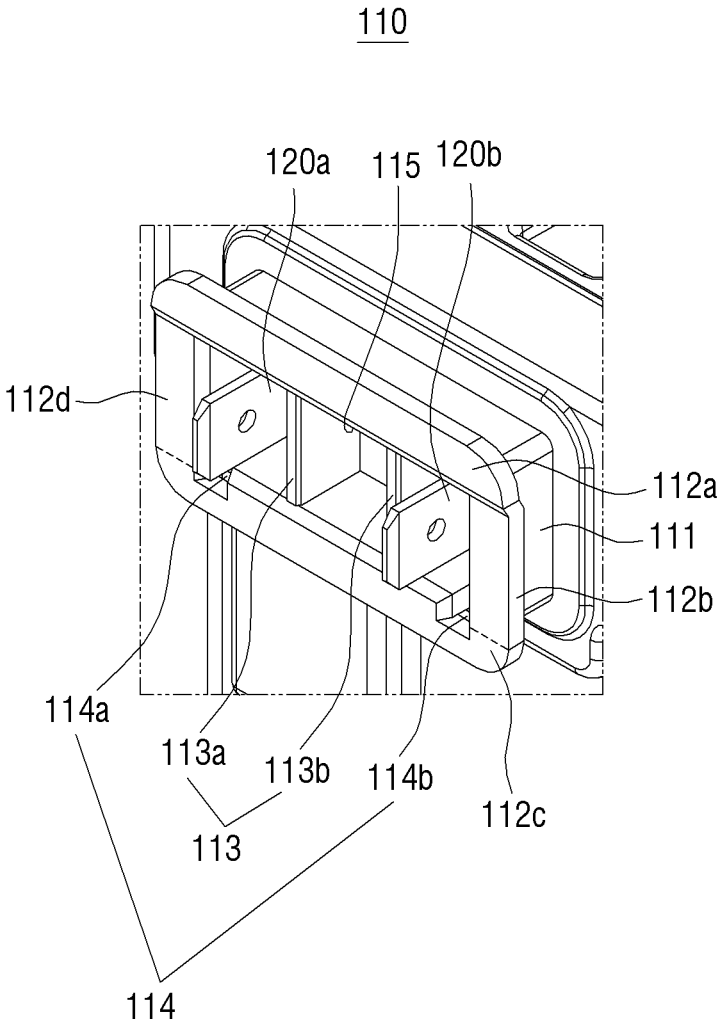
FIG. 4 is an enlarged perspective view illustrating a socket part of the pump motor illustrated in FIG. 3.
Figure 5:
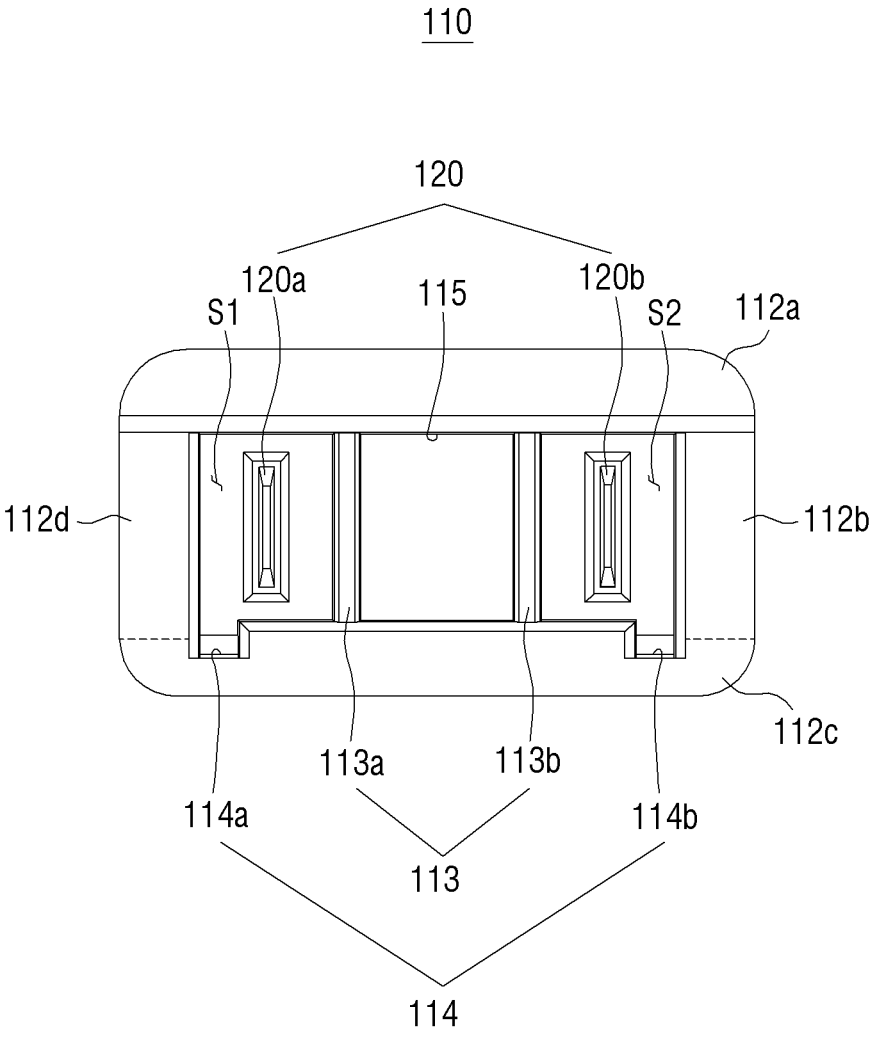
FIG. 5 is a front view of the socket part illustrated in FIG. 4.
Figure 6:
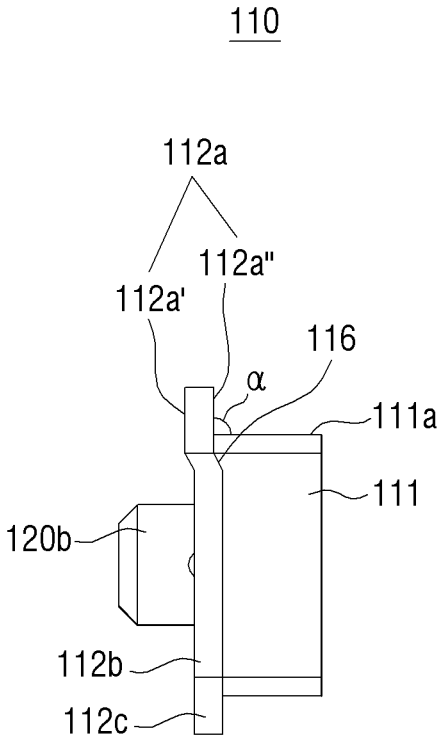
FIG. 6 is a right side view of the socket part illustrated in FIG. 4.

FIG. 4 is an enlarged perspective view illustrating a socket part 110 of the pump motor 10 illustrated in FIG. 3. FIG. 5 is a front view of the socket part 110 illustrated in FIG. 4, and FIG. 6 is a right side view of the socket part 110 illustrated in FIG. 4.

Hereinafter, the structure of the socket part 110 having the terminal part 120 thereinside will be described in detail with reference to FIGS. 4 to 6.

Before the structure of the socket part 110 and its effect are explained, a path through which moisture flows into the pump motor 10 in the operation process of the washing machine 1 is as follows.

In the operation process of the washing machine 1, a large amount of washing water is used for washing laundry, so that periphery of the washing machine 1 may be generally distributed with high moisture. Since the washing machine 1 generates a lot of vibration in the operation process, the washing water or the moisture in the periphery of the washing machine 1 may flow into the pump motor 10. The moisture flowing into the pump motor 10 is condensed and flows down along the surface of the pump motor 10 due to the vibration of the washing machine 1 or gravity so that the moisture may flow into the socket part 110 through a gap between the case 100 and the cover part 200 around the socket part 110. As a result, a tracking phenomenon may occur between the first and second terminals 120*a* and 120*b* inside the socket part 110.

Referring to FIG. 4, the socket part 110 in this embodiment may be provided with the moisture blocking member 112 to prevent the above-described tracking phenomenon.

As described above, the first and second terminals 120*a* and 120*b* may be disposed in the inside of the socket part 110 and an opening 115 opened toward the front may be provided to connect the first and second terminals 120*a* and 120*b* to the electric wire (or plug). In this case, the moisture flowing into the socket part 110 may be primarily blocked by the cover part 200 surrounding the socket part 110. Further, the moisture blocking member 112 may secondarily block the moisture flowing in through the gap between the cover part 200 and the case 100.

Hereinafter, the structure and function of the socket part 110 including the moisture blocking member 112 will be described in detail. The socket part 110 may include a body part 111 surrounding the first and second terminals 120*a* and 120*b* and the moisture blocking member 112 formed along an edge of the body part 111.

The body part 111 may have a shape in which a peripheral portion of the case 100 where the terminal part 120 is disposed protrudes toward the front and may have a shape corresponding to a plug or an outlet connected to the electric wire to be coupled. Accordingly, the body part 111 may be in the form of a wall surrounding the terminal part 120, and the terminal part 120 may be disposed inside the body part 111. Since the body part 111 surrounds the periphery of the terminal part 120, moisture that flows into the terminal part 120 directly from the upper, lower, left, and right sides of the terminal part 120 may be blocked.

The moisture blocking member 112 may protrude outward of the socket part 110 along the edge of the body part 111, and may be bent from the edge of the body part 111 toward the outside of the socket part 110. For example, the moisture blocking member 112 may be in the shape of a flange or rib formed along the edge of the body part 111 toward the outside of the socket part 110.

The moisture blocking member 112 may block the inflow path of moisture that can move to the inside of the socket part 110 along the outer surface of the body part 111. For example, even when the moisture distributed on the outer surface of the body part 111 moves toward the terminal part 120 along the outer surface of the body part 111, the moisture blocking member 112 protruding from the body part 111 may block the moisture which is intended to move toward the inside of the socket part 110 along the outer surface of the body part 111. In addition, the moisture moving along the outer surface of the body part 111 may be removed by flowing down to the lower side of the socket part 110 along the rear surface of the moisture blocking member 112.

Specifically, the moisture blocking member 112 may include an upper member 112*a*, a right member 112*b*, a lower member 112*c*, and a left member 112*d*, depending on the position disposed on the body part 111. The upper member 112*a*, the right member 112*b*, the lower member 112*c*, and the left member 112*d* may be integrally formed.

Since the moisture that can flow into the socket part 110 may move from the upper portion to the lower portion of the socket part 110 by gravity, a large amount of moisture may be distributed on the top surface 111*a* of the body part 111, on which the moisture is less likely to move by gravity, as compared with the bottom surface and opposite side surfaces. Even when the moisture moves toward the opening 115 of the socket part 110 along the top surface 111*a* of the body part 111, the movement path of the moisture may be blocked by the upper member 112*a* bent from the top surface 111*a* of the body part 111 and the moisture that is blocked from moving may fall down below the socket part 110 through the rear surface 112*a*" of the upper member 112*a*, the rear surfaces of the right or left members 112*b* and 112*d* and the rear surface of the lower member 112*c*.

Further, referring to FIG. 6, the upper member 112*a* of the moisture blocking member 112 may be disposed in a state where the upper member 112*a* is advanced toward the front than the right member 112*b*, the lower member 112*c*, and the left member 112*d*. Therefore, an inclined surface 116 may be formed between the upper member 112*a* and the right and left members 112*b* and 112*d*, respectively. Thus, the moisture distributed on the top surface 111*a* of the body part 111 may be removed by easily flowing down along the inclined surface 116 to the lower side of the socket part 110.

In addition, the angle α between the upper member 112*a* of the moisture blocking member 112 and the top surface 11*a* of the body part 111 may be a right angle. By changing the angle α, the moisture that can be distributed on the upper member 112*a* may be easily moved to the lower side of the socket part 110. Also, the top surface 111*a* of the body part 111 may be inclined so that the inclination of the top surface 111*a* of the body part 111 decreases toward the rear where the case 100 is coupled from the front where the moisture blocking member 112 is connected. Thus, the moisture that can flow into the terminal part 120 through the body part 111 may be blocked by moving the moisture distributed on the top surface 111*a* of the body part 111 toward the outer surface of the case 100 which is opposite to the opening 115 of the socket part 110 along the inclined top surface 111*a*.

Further, the socket part 110 in this embodiment may include at least one barrier 113 to prevent the above-described tracking phenomenon.

The barrier 113 may be disposed between the first terminal 120*a* and the second terminal 120*b*. The barrier 113 may partition between the first terminal 120*a* and the second terminal 120*b* by isolating them. Therefore, even when moisture flows into the socket part 110 in which the first terminal 120*a* and the second terminal 120*b* are disposed, the barrier 113 may block the movement path of the moisture between the first terminal 120*a* and the second terminal 120*b*, thereby preventing the tracking.

Further, the barrier 113 may include a first barrier 113*a* and a second barrier 113*b* as illustrated in FIGS. 4 and 5. Thus, the first terminal 120*a* and the second terminal 120*b* may be double isolated from each other by them.

Specifically, referring to FIG. 5, the inside of the socket part 110 may be divided into a first space S1 in which the first terminal 120*a* is disposed and a second space S2 in which the second terminal 120*b* is disposed by the first and second barriers 113*a* and 113*b* provided between the first terminal 120*a* and the second terminal 120*b*. Since the first space S1 and the second space S2 are isolated from each other by the first and second barriers 113*a* and 113*b*, the movement of moisture between the first space S1 and the second space S2 may be blocked.

For example, even when the moisture introduced into the first space S1 in which the first terminal 120*a* is disposed is moved toward the second space S2 in which the second terminal 120*b* is disposed by vibration, the flow of the moisture may be primarily blocked by the first barrier 113*a*. Even if the moisture passes over the first barrier 113*a*, the second barrier 113*b* may shut off the inflow path secondarily. Alternatively, the barrier 113 may be composed of three or more.

Also, the socket part 110 in this embodiment may include at least one drain hole 114 to prevent the above-described tracking phenomenon.

The drain hole 114 may be formed in the lower portion of the socket part 110. The drain hole 114 may be formed in the lower portion of the body part 111 or may be formed between the body part 111 and the moisture blocking member 112. Specifically, the drain hole 114 may be formed in the lower surface of the body part 11 close to the lower member 112*c* of the moisture blocking member 112. Accordingly, the drain hole 114 may discharge moisture, which may be accumulated inside the socket part 110 provided with the terminal part 120, to the outside of the socket part 110.

The drain hole 114 may include a plurality of drain holes, and may be formed in opposite sides of the barrier 113 disposed inside the socket part 110, respectively. For example, as illustrated in FIG. 5, a first drain hole 114*a* is formed in a lower portion of the body part 111 on the first space S1 and a second drain hole 114*b* is formed in a lower portion of the body part 111 on the second space S2. Thus, even if moisture flows into the first and second spaces S1 and S2 in which the first and second terminals 120*a* and 120*b* are disposed, respectively, the moisture may be discharged by the first and second drain holes 114*a* and 114*b*. Thus, the movement of moisture between the first terminal 120*a* and the second terminal 120*b* may be blocked in advance.

In addition, the inner lower portion of the socket part 110 including the drain hole 114 may include an inclined surface inclined toward the drain hole 114. Thus, even when moisture flows into the socket part 110, the inflowing moisture moves toward the drain hole 114 along the inclined surface, so that the moisture may be easily discharged through the drain hole 114. In addition, since the lower portion of the body part 111 on the first space S1 includes an inclined surface inclined toward the first drain hole 114*a* and the lower portion of the body part 111 on the second space S2 includes an inclined surface inclined toward the second drain hole 114*b*, the moisture introduced into the first and second spaces S1 and S2 may be easily discharged through the first and second drain holes 114*a* and 114*b*, respectively.

Figure 7:
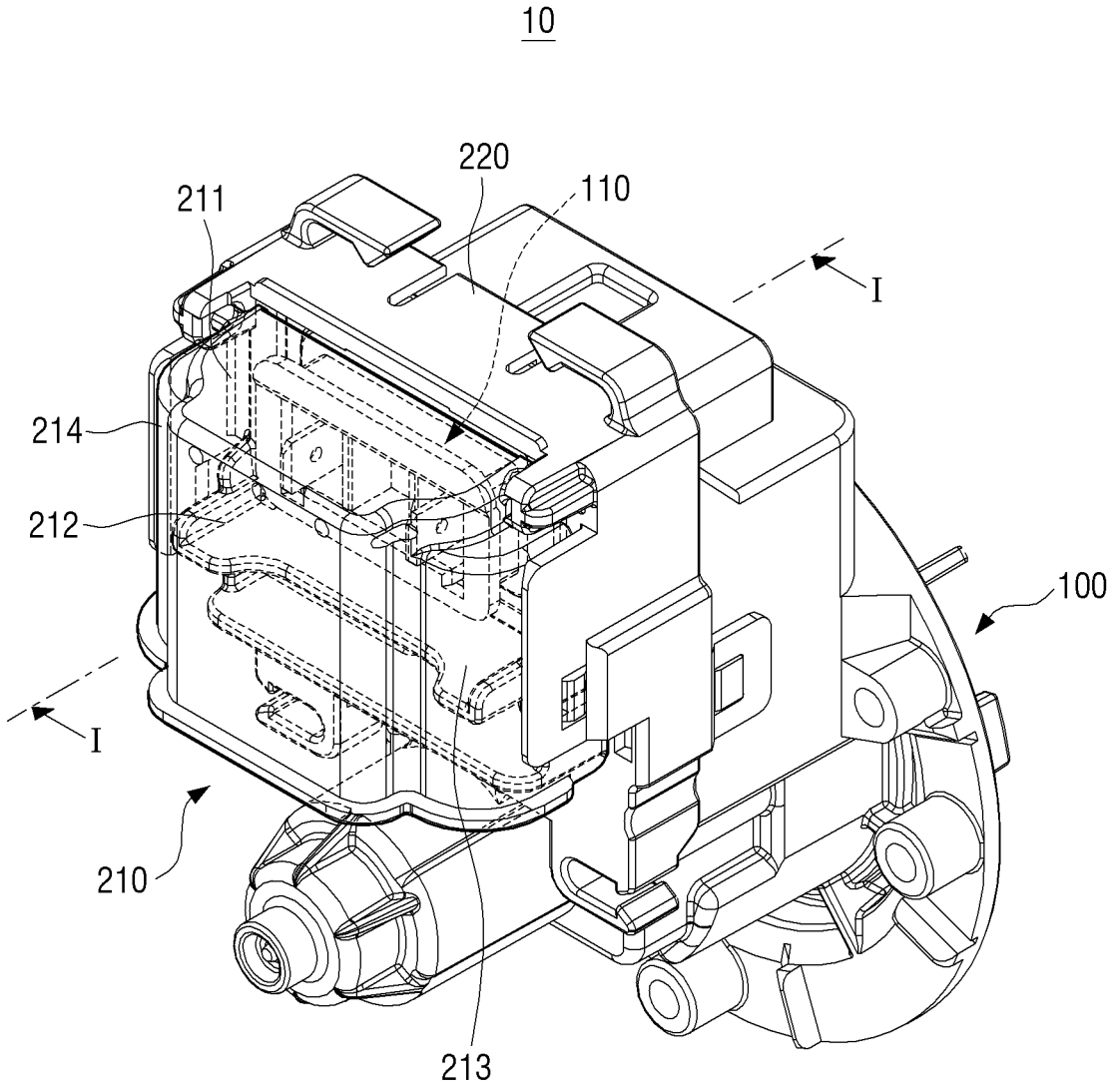
FIG. 7 is a perspective view illustrating a state in which a cover part of the pump motor illustrated in FIG. 2 is closed.
Figure 8:
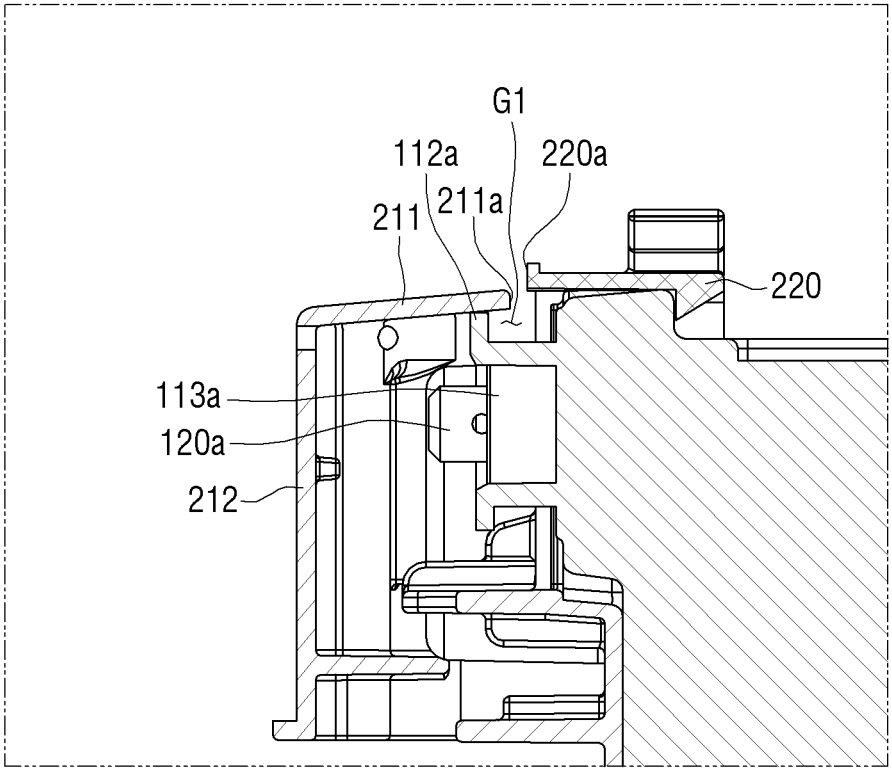
FIG. 8 is a cross-sectional view illustrating the pump motor taken along a line I-I in FIG. 7.
Figure 9:
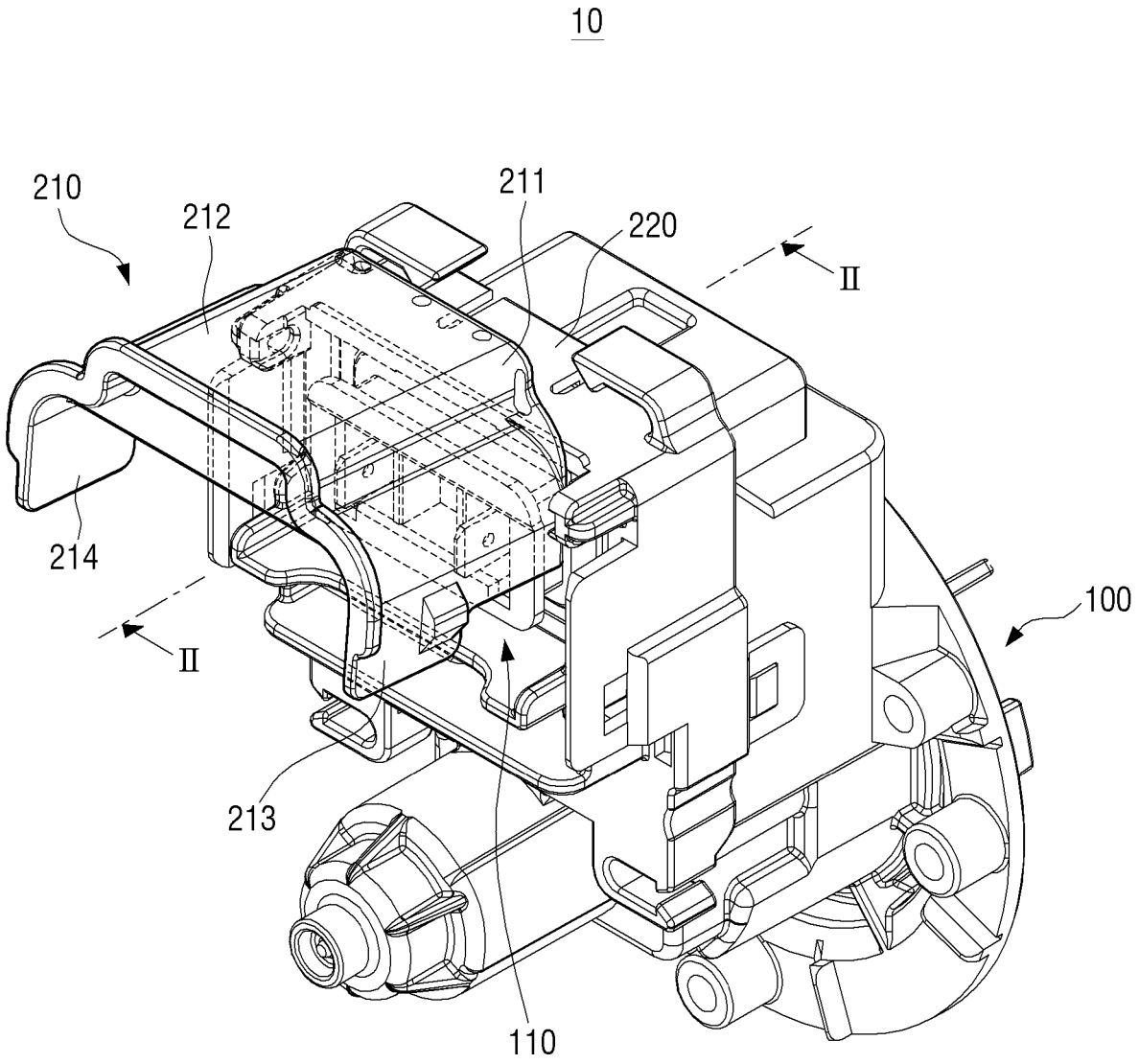
FIG. 9 is a perspective view illustrating a state in which a cover part of the pump motor illustrated in FIG. 2 is opened.
Figure 10:
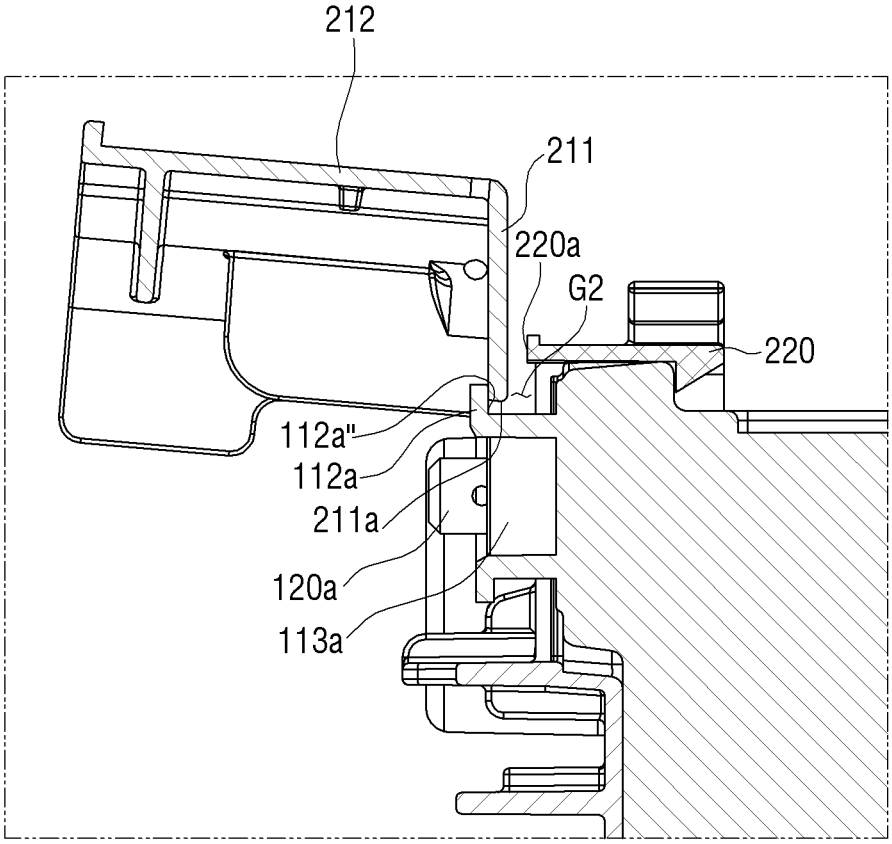
FIG. 10 is a cross-sectional view illustrating the pump motor taken along a line II-II in FIG. 9.

FIG. 7 is a perspective view illustrating a state in which the cover part 200 of the pump motor 10 illustrated in FIG. 2 is closed, and FIG. 8 is a cross-sectional view illustrating the pump motor 10 taken along a line I-I in FIG. 7. FIG. 9 is a perspective view illustrating a state in which the cover part 200 of the pump motor 10 illustrated in FIG. 2 is opened, and FIG. 10 is a cross-sectional view illustrating the pump motor 10 taken along a line II-II in FIG. 9.

Hereinafter, the blocking of the inflow of moisture into the socket part 110 due to the opening and closing of the cover part 200 will be described with reference to FIGS. 7 to 10.

The cover part 200 may include the front cover 210 and the rear cover 220 as described above. The rear cover 220 may be detachably coupled to a portion of the case 100 including the socket part 110 and the front cover 210 may be connected to the rear cover 220 to be openable and closable.

The front cover 210 may include a front surface 212, a top surface 211 bent from the front surface 212, and a right surface 213 and a left surface 214 bent from the front surface 212. When the front cover 210 is closed, the inner space formed by the top surface 211, the front surface 212, the right surface 213, and the left surface 214 may accommodate the socket part 110. The top surface 211 of the front cover 210 may be rotatably connected to the rear cover 220, and the front cover 210 may be opened and closed by rotation.

As illustrated in FIGS. 7 and 8, when the front cover 210 is closed, the socket part 110 may be received in the inner space formed by the top surface 211, the front surface 212, the right surface 213, and left surface 214 of the front cover 210, whereby the socket part 110 may be closed. Accordingly, the moisture distributed outside the cover part 200 may be prevented from flowing into the socket part 110 provided with the terminal part 120.

The front cover 210 may be rotated with respect to the rear cover 220 for opening and closing the front cover 210. To this end, the top surface 211 of the front cover 210 may be rotatably connected to the rear cover 220. In addition, one end 211*a* of the top surface 211 of the front cover 210 and one end 220*a* of the rear cover 220 to which the top surface 211 of the front cover 210 is connected may be spaced apart by a predetermined gap from each other in order to secure a space in which the top surface 211 of the front cover 210 can rotate, and a predetermined gap may be formed between the cover part 200 and the case 100 including the socket part 110.

As illustrated in FIG. 8, when the front cover 210 is closed, the moisture blocking member 112 interferes with the top surface 211 of the front cover 210, thereby shielding the gap that may be formed between the front cover 210 and the case 100. Therefore, the moisture that flows into the first gap G1 formed between the one end 211*a* of the top surface 211 and the one end 220*a* of the rear cover 220 may be prevented from flowing into the socket part 110 through the gap between the cover part 200 and the case 100.

As described above, when the front cover 210 is closed, the moisture blocking member 112 may block the moisture that flows into the socket part 110 through the first gap G1 between the front cover 210 and the rear cover 220 and the gap between the cover part 200 and the case 100, thereby easily preventing the tracking phenomenon.

As illustrated in FIGS. 9 and 10, when the front cover 210 is opened, the socket part 110 may be opened toward the front, and the electric wire may be easily connected to the terminal part 120 through the opening.

When the front cover 210 is opened from a closed state, the moisture distributed on the outer surface of the front cover 210 may move to the lower side of the front cover 210 along the top surface 211 of the front cover 210 by gravity.

As illustrated in FIG. 10, when the front cover 210 is opened, the rear surface 112*a*" of the upper member 112*a* of the moisture blocking member 112 may interfere with a part of the top surface 211 of the front cover 210. Thus, the top surface 211 of the front cover 210 may shield the rear surface of the moisture blocking member 112, and the moisture blocking member 112 may shield the gap formed between the front cover 210 and the case 100.

Accordingly, even when the moisture moving downward along the top surface 211 of the front cover 210 flows into the second gap G2 formed between the one end 211*a* of the top surface 211 of the front cover 210 and the one end 220*a* of the rear cover 220, the inflowing moisture may be prevented from flowing into the socket part 110 through the gap between the cover part 200 and the case 100.

As described above, when the front cover 210 is opened, the moisture blocking member 112 may block the moisture from flowing into the socket part 110 through the second gap G2 between the front cover 210 and the rear cover 220 and the gap between the cover part 200 and the case 100, thereby easily preventing the tracking phenomenon.

As described above, the pump motor 10 according to an embodiment of the present disclosure and the washing machine 1 having the same may primarily block the moisture that flows into the socket part 110 provided with the terminal part 120 through the cover part 200 detachably coupled to the case 100 of the pump motor 10.

In addition, the moisture that flows into the socket part 110 may be secondarily blocked by shielding the gap formed between the front cover 210 and the rear cover 220 and the gap formed between the cover part 200 and the case 100 including the socket part 110 for opening and closing the front cover 210 constituting the cover part 200 through the moisture blocking member 112.

Further, even if moisture flows into the inside of the socket part 110 provided with the terminal part 120, the inflowing moisture may be easily discharged through the drain hole 114 provided in the lower portion of the socket part 110, and even if some moisture that has not been discharged remains inside the socket part 110, the barrier 113 provided with between the first terminal 120*a* and the second terminal 120*b* may block the movement of the moisture from the first terminal 120*a* to the second terminal 120*b* or from the second terminal 120*b* to the first terminal 120*a*. Accordingly, the tracking phenomenon, which may be caused by the inflow of the moisture into the first terminal 120*a* and the second terminal 120*b*, may be effectively prevented, and the fire due to the tracking may be prevented, so that the stability of the pump motor 10 and the washing machine 1 having the same may be increased.

In the embodiment of the present disclosure, the washing machine 1 provided with the pump motor 10 has been described as an example of household appliances. However, the pump motor 10 according to an embodiment of the present disclosure may be applied to various household appliances having a pump such as a dishwasher, a water purifier, or the like.

In the above description, although various embodiments of the present disclosure are described individually, the respective embodiment is not necessarily solely implemented, the configuration and operation of the respective embodiments may also be implemented in combination with at least one of other embodiments.

In the above description, although the exemplary embodiments of the present disclosure have been shown and described, it should be understood that the present disclosure is not limited to the disclosed embodiments and may be variously modified without departing from the spirit and the scope of the present disclosure. Therefore, the modifications should not be understood separately from the technical spirit or scope of the present disclosure.

What is claimed is:

1. A washing machine comprising:
a main body;
a water tub provided inside the main body to store washing water;
a rotary tub rotatably disposed inside the water tub and configured to accommodate laundry; and
a drain device configured to discharge the washing water that is accommodated in the water tub,
wherein the drain device comprises:
a pump;
a first drainage pipe connecting the water tub and the pump; and
a second drainage pipe to discharge the washing water past the pump to an outside of the main body,
wherein the pump comprises a pump motor, and
wherein the pump motor comprises:
a case; and
a socket part,
wherein the socket part includes:
a terminal part; and
a body part around the terminal part,
wherein the body part includes a plurality of drain holes provided in a lower portion of the body part.

2. The washing machine of claim 1, wherein the body part comprises an inclined surface inclined toward the plurality of drain holes.

3. The washing machine of claim 1, wherein the terminal part includes a first terminal and a second terminal, and
wherein the body part includes a plurality of barriers partitioning between the first terminal and the second terminal and wherein the plurality of drain holes is disposed with the plurality of barriers in between.

4. The washing machine of claim 1, further comprising a moisture blocking member configured to block moisture from flowing into the socket part.

5. The washing machine of claim 1, wherein the plurality of drain holes includes a first drain hole and a second drain hole.

6. The washing machine of claim 3, wherein the plurality of drain holes includes a first drain hole and a second drain hole, and wherein the first drain hole is provided in a first space of the body part in which the first terminal is disposed and the second drain hole is provided in a second space of the body part in which the second terminal is disposed.

7. The washing machine of claim 4, wherein the moisture blocking member is formed around the terminal part.

8. The washing machine of claim 7, wherein the moisture blocking member is formed as a flange or rib around the terminal part.

9. The washing machine of claim 7, wherein the moisture blocking member is formed to extend outward of the socket part.

10. The washing machine of claim 7, wherein the moisture blocking member comprises at least one of an upper member, a right member, and a left member depending on a position relative to the body part.

11. The washing machine of claim 10, wherein an angle between the upper member and a top surface of the body part is a right angle.

12. The washing machine of claim 10, wherein the moisture blocking member comprises the upper member, the right member, and the left member.

13. The washing machine of claim 12, wherein the upper member, the right member, and the left member of the moisture blocking member are integrally formed.

14. The washing machine of claim 3, wherein the plurality of barriers includes a first barrier and a second barrier disposed between the first terminal and the second terminal, and
wherein a first space in which the first terminal is disposed and a second space in which the second terminal is disposed are isolated from each other.

15. A washing machine comprising:
a main body;
a water tub provided inside the main body to store washing water;
a rotary tub rotatably disposed inside the water tub and configured to accommodate laundry; and
a drain device configured to discharge the washing water that is accommodated in the water tub,
wherein the drain device comprises:
a pump;
a first drainage pipe connecting the water tub and the pump; and
a second drainage pipe to discharge the washing water passed the pump to an outside of the main body,
wherein the pump comprises a pump motor, and
wherein the pump motor comprises:
a case;
a socket part; and
a moisture blocking member configured to block moisture from flowing into the socket part,
wherein the socket part includes:
a terminal part; and
a body part around the terminal part, wherein the body part includes a plurality of drain holes provided in a lower portion of the body part.

16. The washing machine of claim 15, wherein the moisture blocking member is formed around the terminal part.

17. The washing machine of claim 15, wherein the moisture blocking member is formed as a flange or rib around the terminal part.

18. The washing machine of claim 15, wherein the moisture blocking member comprises an upper member, a right member, and a left member.

19. The washing machine of claim 15, wherein the moisture blocking member comprises at least one of an upper member, a right member, and a left member depending on a position relative to the body part.

20. The washing machine of claim 15, wherein the terminal part includes a first terminal and a second terminal, and wherein the body part includes a plurality of barriers partitioning between the first terminal and the second terminal and wherein the plurality of drain holes is disposed with the plurality of barriers in between.

* * * * *